United States Patent [19]
Irvine
[11] 4,290,593
[45] Sep. 22, 1981

[54] METHOD FOR SHEET FEEDING

[75] Inventor: Robert Irvine, Riverside, Conn.
[73] Assignee: Pitney Bowes Inc., Stamford, Conn.

[21] Appl. No.: 52,521
[22] Filed: Jun. 27, 1979

Related U.S. Application Data

[63] Continuation-in-part of Ser. No. 836,364, Sep. 26, 1977, abandoned.

[51] Int. Cl.[3] ..... B65H 3/02; B65H 3/56
[52] U.S. Cl. ..... 271/42; 271/170
[58] Field of Search ..... 271/42, 128, 129, 130, 271/170, 19, 139; 414/131, 119; 221/259, 262, 40

[56] References Cited

U.S. PATENT DOCUMENTS 2,062,643 12/1936 Edmunds ..... 271/42
2,569,837 9/1951 Robinson ..... 271/42
2,588,946 3/1952 Walden et al. ..... 271/42
3,744,789 7/1973 Kolibas ..... 271/42
4,026,538 5/1977 Brown et al. ..... 271/42

*Primary Examiner*—Bruce H. Stoner, Jr.
*Attorney, Agent, or Firm*—Peter Vrahotes; William D. Soltow, Jr.; Albert W. Scribner

[57] ABSTRACT

A sheet feeding method is disclosed that provides two feed strokes for each feed cycle. Each sheet may be fed during the first stroke. In the event, however, that the sheet fails to feed during this first stroke, the second stroke of the cycle will enable the sheet to be fed. The sheet feeding device comprises an over-head feed roller that is biased into contact with the top sheet of a stack of sheets. The feed roller has forward courses and a backward course of travel during each feed cycle.

2 Claims, 4 Drawing Figures

METHOD FOR SHEET FEEDING

RELATED APPLICATIONS

This application is a continuation-in-part of applicant's prior patent application, Ser. No. 836,364, filed Sept. 26, 1977 and now abandoned.

BACKGROUND OF THE INVENTION

This invention pertains to a sheet feeding method, and more particularly to a sheet feeding method for feeding sheets of different thicknesses from a collator.

Many sheet feeding devices use corner separators to facilitate feeding sheets individually. It is common to find jams and mis-feeds in such sheet feeding devices. No matter how reliable a system is, every now and then a sheet will stick or be misaligned causing a jam or a double feed. This is often occasioned by the fact that a sheet feeding device is required to feed both thin sheets and sheets of greater thickness, thus resulting in sheets having varying stiffness factors. When feeding thin, flexible sheets, if the feed stroke is too large the thin sheet would tend to buckle. Consequently, a short stroke would be preferable for thin sheets. On the other hand, a short stroke may not be sufficient to overcome the stiffness of sheets that are thick.

The present invention is addressed to the problem of reliability in the feeding of sheet material from a stack of sheets.

SUMMARY OF THE INVENTION

The invention relates to a sheet feeding method having two feed strokes for each feed cycle, a short stroke and a long stroke. Such feeding is not merely a duplication of effort, because the two forward feeding strokes are part of one cycle. If a sheet fails to be fed during the first, short feed stroke, as when thick, stiff sheets are being fed, the second, long feed stroke will insure its being fed, because the sheet will be less stiff on the long feed stroke. On the other hand, when thin, flexible sheets are being fed, the first feed stroke should feed the top sheet only because its position induces stiffness in the thinner sheets.

The invention comprises at least one sheet supporting tray for supporting the sheets in a stack. The tray has corner separators on its forward end to insure that sheet material will be separated and fed one-at-a-time (in seriatim). An overhead feed roller is movably disposed above the stack of sheets and is biased into contact with the top sheet of the stack. The roller has forward courses and a backward course of travel defining a cycle feed path. The roller has a rest position intermediate the end limits of the cyclic feed path. The roller is in frictional contact with the sheet material during the forward courses of travel. The first feed stroke of the roller is defined as the progression of the roller from the rest position to a forward end or limiting position of the cyclic feed path. The second feed stroke is defined as a forward progression of the roller from a rearward end or limiting position of the cyclic feed path to the rest position.

It is an object of this invention to provide an improved sheet feeding method;

It is another object of the invention to provide a sheet feeding method of improved reliability;

It is a further object of this invention to provide a sheet feeding method having two feed strokes for each feed cycle.

It is a still further object of the invention to feed a stack of sheets with reliability regardless of the thickness and/or stiffness of the sheets.

These and other objects of the invention will be better understood and will become more apparent with reference to the following detailed description taken in conjunction with the accompanying drawing, in which:

FIG. 1 is a side view of a sheet feeding device utilizing the instant invention and shown with its feed roller in a rest position;

FIG. 1*a* is a side view of the invention similar to FIG. 1, with the feed roller depicted in a forward end position;

FIG. 2 is a schematic view of the cyclic path of the feed roller of FIGS. 1 and 1*a;* and FIG. 3 is a cross sectional view of a portion of a collator demonstrating the method of the invention.

DETAILED DESCRIPTION

Figure 1:
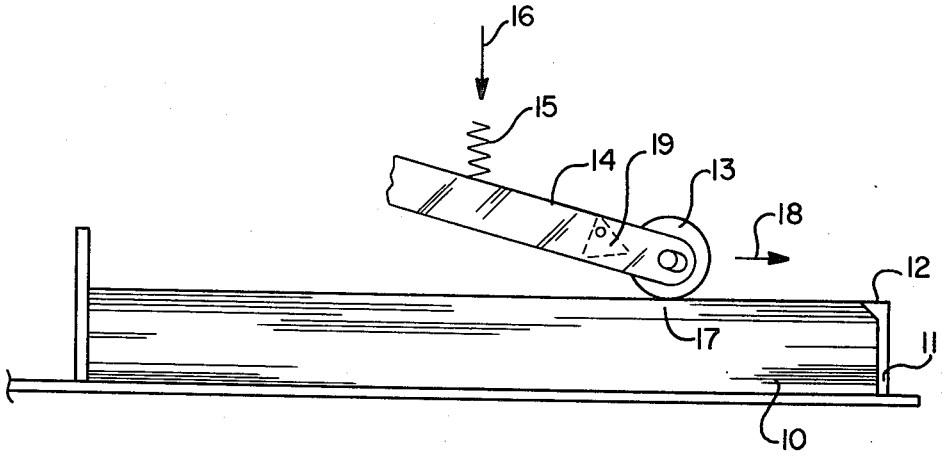
Figure 1A:
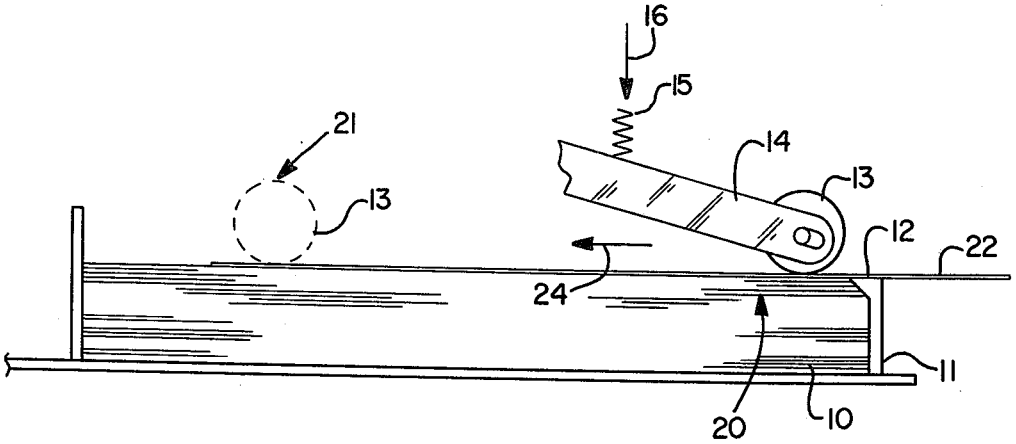

Now referring to FIG. 1, a sheet feeding device utilizing the method of this invention is shown. A stack of sheets 10 is supported in tray 11. The tray 11 has corner separators 12 for providing that only one sheet at a time (in seriatim) will be fed from the tray as is well known in the art.

An overhead feed roller 13 is in contact with the top sheet of the stack 10. The roller 13 is supported on an arm 14, which is spring biased by spring 15 towards (as indicated by arrow 16) stack 10.

The arm 14 and roller 13 are shown in a rest position 17 in FIG. 1. When it is desired to feed the top sheet from the stack, the arm 14 and roller 13 are advanced on a first forward stroke toward the corner separators as shown by arrow 18. The roller 13 does not roll upon, or otherwise rotate with respect to, the stack 10 when it is forwardly advanced. This results from a feed brake 19. A one-way clutch can also be used for this purpose.

Figure 2:
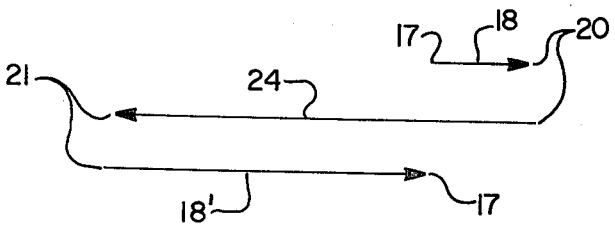
Figure 3:
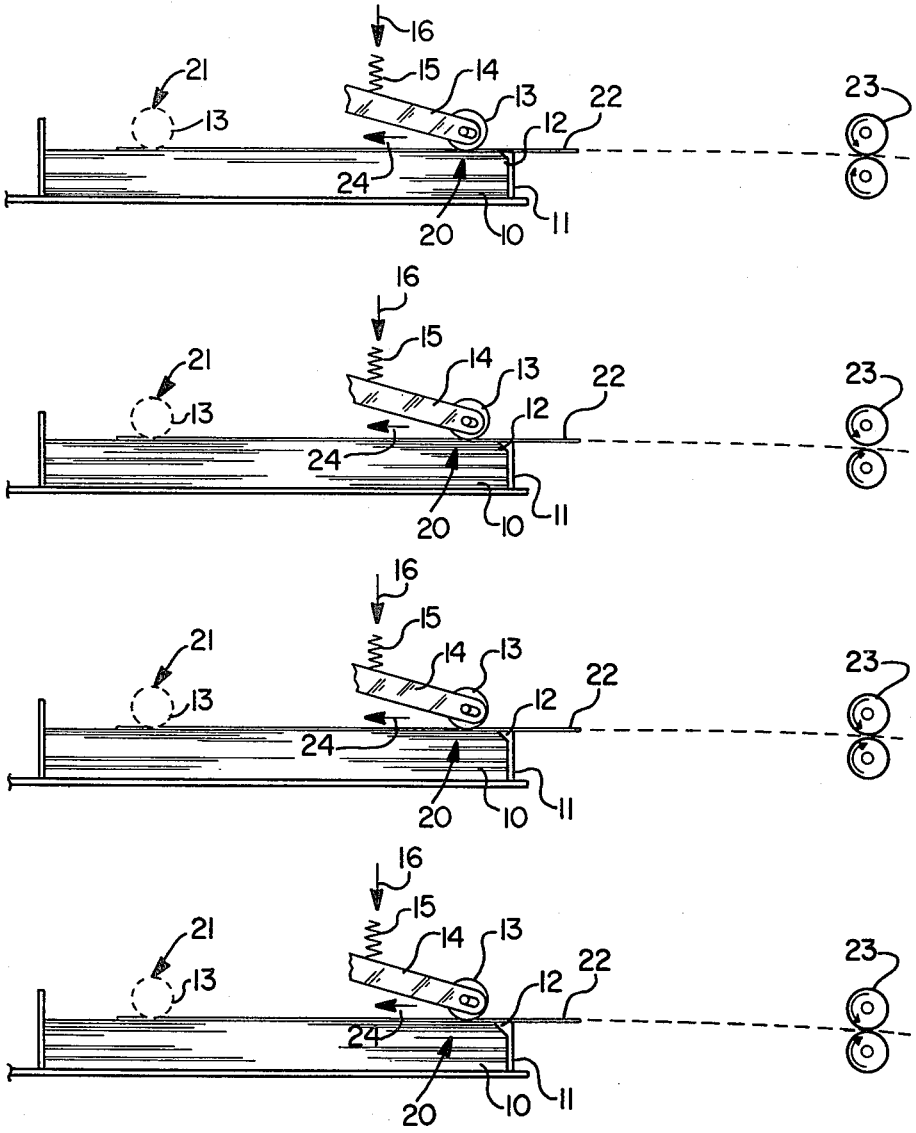

The arm 14 and roller 13 are advanced fowardly to a front end position 20 shown in FIG. 2. The roller 13, having been in frictional contact with the top sheet, will tend to cause the top sheets 22 to buckle thereby allowing the forward corners of the top sheet to be removed from the corner separators 12. The top sheet 22 will only be advanced a short distance. As seen in FIG. 3, such advancing of the sheets would be visible to an operator of a collator.

The arm 14 and roller 13 will now be advanced rearwardly (arrow 24) until the rearmost position 21 is reached. In its rearward travel, the roller 13 is able to roll upon the top sheet of the stack 10. This is because the feed brake 19 only acts to prevent roller rotation in the forward direction (arrow 18). As aforementioned, a one-way clutch can also be used for this purpose.

When the roller 13 reaches the rearward end point 21, it is again advanced forwardly (arrow 18' of FIG. 2) to the initial rest position 17. With such movement, a thin sheet 22 which had previously been advanced a short distance will be fully advanced. Thicker sheets 22, on the other hand, will be conveyed by the second forward stroke of the cycle. A thicker sheet 22 may not have separated from the corner separators 12 on the first stroke due to its greater stiffness. With the roller 13 in the rearmost position 21, less stiffness is exhibited in a thicker sheet 22 therby allowing the same to be removed from the corner separator 12.

The complete cycle of movement of roller 13 is illustrated in schematic fashion in FIG. 2. As can be seen from FIG. 2, the roller 13 has two separate forward strokes 18 and 18'. The feed stroke 18' will insure that the top sheet 22 will be fed in the event that the sheet 22 was not fed on the first feed stroke 18 as may occur with a thick sheet.

The value of the invention when used with a collator is illustrated in FIG. 3 wherein the sheets 22 would be fed in unison to a position where they can be removed by an operator or, alternately, to feed rollers 23 which would have sufficient power to completely remove sheets from the trays 11.

The present invention has several advantages over the prior systems:

(a) By breaking up the feed cycle according to that shown in FIG. 2, two opportunities to feed a sheet are obtained, where before only one existed;

(b) A better separation is achieved for thin sheets because roller 13 starts closer to the corner separators 12. This prevents buckling of thin sheets and subsequent jamming by inducing thickness therein;

(c) A better separation is achieved for thick sheets because the roller 13 starts a distance from the corner separators on its second stroke thereby diminishing the effect of thickness.

(d) An operator has a chance to observe the sheet (visual inspection) during the rearward travel of roller 13.

Having thus described the invention, what is desired to be covered by Letters Patent is presented by the following appended claims.

What is claimed is:

1. In a method of feeding a sheet along a longitudinal path from a stack of sheets, which stack of sheets may include relatively thin or relatively thick sheets, the steps comprising:

(a) supporting a stack of sheets;

(b) applying corner separators to laterally opposed corners of the top sheet of the stack of sheets;

(c) locating a feed roller above the stack in biased contact with said top sheet of the stack of sheets;

(d) moving the feed roller forward for a first stroke from a rest position toward the corner separators with the roller being in frictional contact with said top sheet;

(e) moving the feed roller away from the corner separators in rolling contact with said top sheet to a location further removed from the corner separators than the rest position; and (f) moving the feed roller on a second stroke toward the corner separators in frictional contact with said sheet, said second stroke being longer than said first stroke and terminating at the rest position, the shorter length of the first stroke inducing stiffness and diminishing the buckling and jamming effects of the corner separators on relatively thin sheets so that said feed roller causes a relatively thin top sheet to separate from the corner separators on the first stroke and be partially advanced from the stack, which thin top is subsequently further advanced by the feed roller on the second stroke, and the longer length of the second feed stroke diminishing the resistance of relatively thick sheets to removal from the corner separators so that a relatively thick top sheet which is not removed from the corner separators by said feed roller on the first stroke will be removed therefrom and advanced from the stack on the second stroke.

2. The method of claim 1 wherein steps (d) through (f) are repeated to feed successive top sheets.

* * * * *

UNITED STATES PATENT AND TRADEMARK OFFICE

CERTIFICATE OF CORRECTION

PATENT NO. : 4,290,593

DATED : June 27, 1979

INVENTOR(S) : Robert Irvine

It is certified that error appears in the above-identified patent and that said Letters Patent are hereby corrected as shown below:

Claim 1, column 4, line 18, "sheet" should be --top sheet--.

Claim 1, column 4, line 26, "top" should be --top sheet--.

Signed and Sealed this

*Twenty-third* Day of *November 1982*

[SEAL]

*Attest:*

GERALD J. MOSSINGHOFF

*Attesting Officer*

*Commissioner of Patents and Trademarks*